United States Patent [19]

Galimberti nee Sestini

[11] 4,209,708

[45] Jun. 24, 1980

[54] WEB-FEED CONTROL APPARATUS

[76] Inventor: Grazia Galimberti nee Sestini, Via Pancaldo 4, Milan, Italy

[21] Appl. No.: 899,858

[22] Filed: Apr. 25, 1978

[30] Foreign Application Priority Data

Apr. 28, 1977 [IT] Italy ..... 9424 A/77

[51] Int. Cl.[2] ..... G01N 21/30

[52] U.S. Cl. ..... 250/548; 226/45

[58] Field of Search ..... 250/548, 561, 208, 209; 226/45

[56] References Cited

U.S. PATENT DOCUMENTS

| | | | |
|---|---|---|---|
| 3,323,700 | 6/1967 | Epstein et al. | 250/548 |
| 3,339,817 | 9/1967 | French | 226/45 |
| 3,399,306 | 8/1968 | Guastavino | 250/548 |

*Primary Examiner*—David C. Nelms

*Attorney, Agent, or Firm*—Hopgood, Calimafde, Kalil, Blaustein & Lieberman

[57] ABSTRACT

The feeding of a plurality of material webs to a machine for simultaneous processing of the webs, is controlled by web-feed control apparatus arranged to synchronize feeding of the webs relative to each other. This synchronization is effected by using optical sensors to detect spacing marks along each web and then controlling the rate of advance of each web such that the spacing marks pass the optical sensors simultaneously for all the webs. The rate of web advance may be controlled by selective activation of braking devices or by varying the drive to the advancing means of each web.

7 Claims, 4 Drawing Figures

WEB-FEED CONTROL APPARATUS

BACKGROUND OF THE INVENTION (a) Field of the Invention

This invention relates to web-feed control apparatus for synchronising the feed of a plurality of webs with respect to each other to facilitate subsequent simultaneous processing of the webs.

(b) Description of the Prior Art

In processing material webs it is often required to carry out some operation on the web itself with reference to a mark or print applied to the web. When processing webs of packaging material (plastic materials, paper and the like) is concerned, it is also often necessary to cut and/or weld and/or overprint the web with reference to a pre-established and repeated length and in a predetermined relationship to a reference preprinted on each length. In practice it has proved impossible to carry out these operations based on measurements mechanically derived from the moving web insofar as slippage has been found to occur between traction members and the web and the elasticity of the web itself gives rise to uncertainty as to the positioning of printed markings.

It has therefore become the practice to use photocells which are arranged to sense marks provided along the web and thereby enable control of the position of the web to be corrected to its theoretical one (that is, its position if slippage and stretching were absent).

However, when it is desired to process two or more preprinted webs simultaneously on one machine the spread of deviations of the individual webs from their theoretical positions as determined by the set rate of web advance creates a considerable problem in simultaneously correctly positioning all the webs for processing by the machine.

To meet this problem the machine can be provided with independent web advance systems for each web. These advance systems detect by means of photocells the positional error of each web with respect to its theoretical position and then seek to adjust the web position to the theoretical one. Such a solution which has been used for a long time, is however complicated, expensive and liable to wear.

SUMMARY OF THE INVENTION

According to one aspect of the invention, there is provided web-feed control apparatus for automatically synchronising the feeding of a plurality of material webs to facilitate simultaneous processing of said webs, the apparatus comprising web feed means for advancing the webs along respective paths, respective optical sensors juxtaposed each web path and arranged to output respective signals on sensing predetermined marks on their corresponding webs, non-simultaneous occurence of the sensor output signals corresponding to the advance of a said mark on one said web relative to corresponding mark or marks on the, or the other, webs, and web feed rate control means operative upon non-simultaneous occurence of the sensor output signals to vary the relative feed rates of the webs with respect to each other until the said signals occur together indicating that said advance has been annulled.

Thus for two or more pre-printed webs unwinding from reels, the web-feed control apparatus of the invention can be seen to utilise the concept that the pitch differences that can be ascertained between the webs derive exclusively from mistakes or inaccuracies of the machines that carried out printing on the webs, and by reconstructing these errors prior to feeding the webs to the next machine, the webs can be re-synchronised to their state as they left the printing machine.

According to another aspect of the invention, there is provided web feed control apparatus for synchronising the feed of a plurality of webs with respect to each other, the apparatus comprising web feed means arranged to advance each web along a respective feed path, optical monitoring means including respective sensors arranged in closely spaced relaion to each feed path, said optical means serving to monitor the degree of synchronisation between the webs by said sensors detecting spaced marks therealong and to generate correction signals for restoring synchronisation between the webs, and feed rate control means arranged to control the relative feed rates of the webs along their feed paths in dependence on the correction signals generated by the optical monitoring means whereby to synchronise feeding of the webs.

BRIEF DESCRIPTION OF THE DRAWINGS

Several forms of web-feed control apparatus embodying the invention will now be particularly described, by way of example, with reference to the accompanying diagrammatic drawings in which.

DESCRIPTION OF THE PREFERRED EMBODIMENTS

Figure 1:
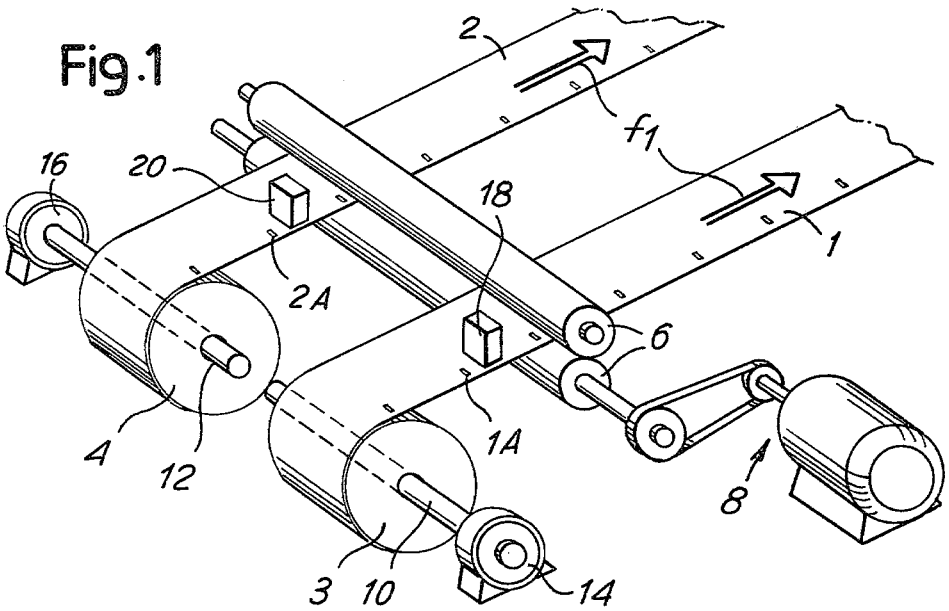
FIGS. 1 and 2 are perspective views of respective forms of web-feed control apparatus each incorporating braking means for controlling web feed rate.

As shown in FIG. 1, two webs 1 and 2 of sheet material are drawn from two reels 3 and 4 respectively, and advanced in the direction indicated by the arrows f1 along respective web feed paths by web advance means. In FIG. 1, the advance means comprises a pair of cooperating rollers 6 one of which is driven by a motor 8. The advancing action of the rollers 6 on the webs 1 and 2 may be slightly different owing to possible slipping between the webs 1 and 2 and the rollers 6 or stretching of the webs under the tractive forces imposed on the webs by the rollers 6. The two reels 3 and 4 are mounted on axles 10 and 12 provided with respective braking means 14 and 16 which constitute feed rate control means for the webs 1 and 2 respectively.

Photoelectric cells 18 and 20 of optical monitoring means of the apparatus are mounted above the web feed paths to respectively sense the presence of spaced marks 1A and 2A along the edges of webs 1 and 2. These marks 1A and 2A may include slits or notches. Simultaneous sensing of marks 1A and 2A by the photocells 18 and 20 corresponds to the feed of the webs 1 and 2 being synchronised as required. Upon one of the webs 1 or 2 being advanced faster than the other web, the sensing of the marks 1A and 2A by the photocells 18 and 20 will no longer be simultaneous indicating that the webs are no longer being fed in synchronism. As a result, the optical monitoring means is arranged to generate a correction signal to activate one of the braking means 14 or 16 to restore synchronisation between the webs 1 and 2.

Thus if a mark 1A is sensed before the corresponding mark 2A, the braking means 14 is activated to slow feed of the web 1 with respect to the web 2, which is not braked; this will cause re-synchronisation of feeding of the webs 1 and 2 and the braking means 14 will then be de-activated. Conversely, unwinding of the web 2 is braked by the braking means 16 if the photocell 20 senses the presence of a mark 2A before the photocell 18 senses the corresponding mark 1A.

Figure 2:
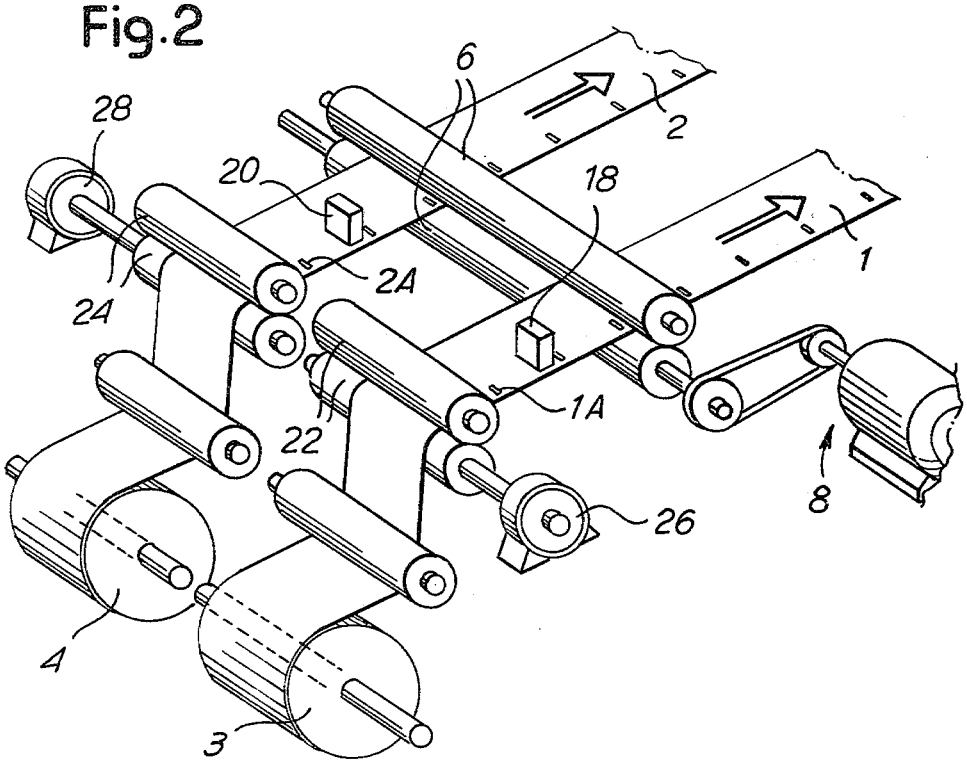

The form of the apparatus shown in FIG. 2 is similar to that of FIG. 1 and corresponding elements have been similarly referenced. In this case two independent pairs of rollers 22 and 24 are provided to exert independent braking actions on the webs 1 and 2, the braking action being caused by two braking devices 26 and 28 which are equivalent to the braking means 14 and 16 of FIG. 1. The difference between the FIG. 1 and FIG. 2 forms of apparatus is that in the latter braking is effected not on the reel-bearing axles but via the pairs of rollers 22 and 24 directly on the webs 1 and 2.

From the foregoing it can be seen that to achieve synchronisation between feeding of the webs 1 and 2, it is sufficient to vary the braking intensity in one or other web feed systems so as to cause an increased tension of the web that tends to advance too much in respect of its neighbour. In this manner the webs can be synchronised as they are fed forward by the rollers 6 into a machine arranged to operate simultaneously on all webs.

Braking can be carried out in a known manner (for example, by electric, pneumatic or mechanical means) either directly on the reel-bearing axles (FIG. 1) or through intermediate rollers put into rotation by the two webs (FIG. 2). Both these forms of the web feed control apparatus can be considered as passive ones, since control action is not effected directly on the web advancing means itself.

Figure 3:
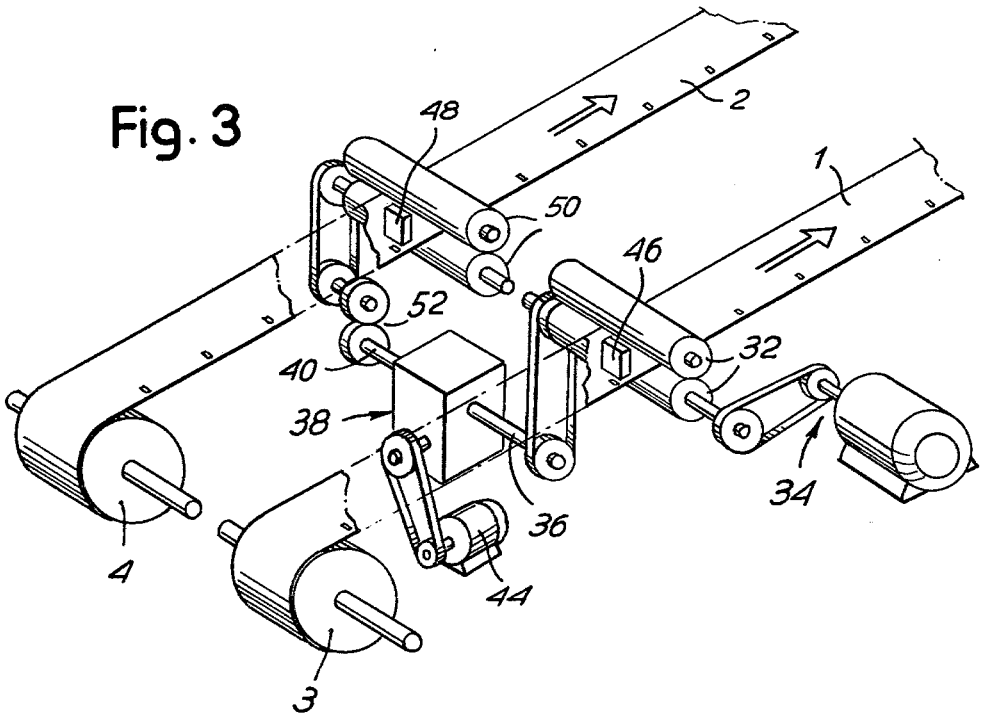
FIG. 3 is a perspective view of another form of the apparatus, this form incorporating epicyclic gearing.

In the form of apparatus shown in FIG. 3, a first pair of web advance rollers 32 is driven directly by a motor 34, which also drives the input shaft 36 of an epicyclic gearing 38 arranged as a differential unit and including an output shaft 40 and a spider box 42 (carrying the planet gears of the unit) which is arranged to rotate about the common axis of shafts 36 and 40 on actuation of a motor 44. The output shaft 40 drives a second pair of web advance rollers 50 via gearing 52. The drive ratio through the differential unit and the gearing 52 is 1:1 and thus when the spider box 42 is kept stationary the two roller pairs 32 and 50 rotate at the same speed.

In this form of the apparatus, the optical monitoring means comprises photocells 46 and 48 and is arranged to output correction signals to the motor 44 upon detection that feed of the webs 1 and 2 is out of synchronisation. These correction signals cause the motor 44 to rotate in one direction or the other in dependence on whether sensing of the marks on the web 1 is in advance or behind the sensing of the corresponding marks of the web 2. As a result the feed rate of the web 2 as determined by the rollers 50 will be increased or decreased with respect to the feed rate of the web 1 determined by the rollers 32. Energisation of the motor 44 continues until synchronisation of the webs (simultaneous sensing of marks on the two webs 1 and 2) is achieved. The gearing 38 and the motor 44 can thus be seen to constitute feed rate control means enabling the relative web feed rates to be adjusted.

Figure 4:
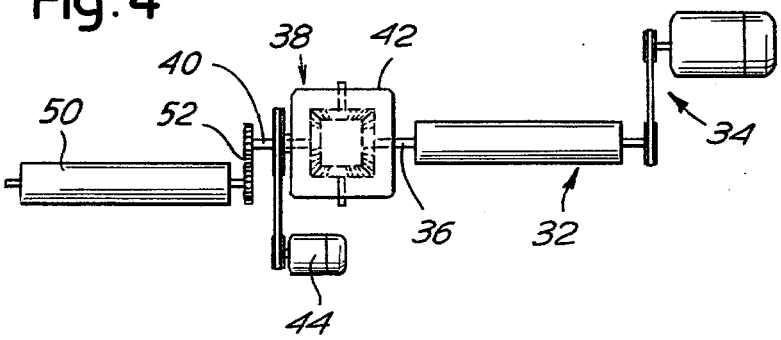
FIG. 4 shows an alternative arrangement of the form of apparatus shown in FIG. 3.

An alternative arrangement of the elements of the feed rate control means of FIG. 3 is shown in FIG. 4.

The forms of the apparatus shown in FIGS. 3 and 4 can be considered as active ones with feed rate control action being effected directly on the web advance means, that is, the driven rollers feeding the webs forward into a following machine in which all webs are simultaneously operated on.

The described web-feed control apparatus is intended for use in controlling web synchronisation where a number of webs are fed into a machine for simultaneous operation on thereby. Typically the webs are plastics sheets carrying printing requiring the webs to be exactly positioned during working.

In certain cases, for example with webs carrying complex prints, it may only be required to check web synchronisation in predetermined zones. In these cases, a web length counter can be provided to gate the outputs of the photocells appropriately.

The position of the photocells in the described apparatus should be as near as possible to the web advance rollers to ensure best synchronisation of the webs as they are fed forward; however, the photocells can be positioned away from these rollers if the tolerances set will accommodate this. In this case one of the photocells can be the photocell normally found on the following web operating machine.

I claim:

1. Web-feed control apparatus for automatically synchronising the feeding of a plurality of material webs to facilitate simultaneous processing of said webs, the apparatus comprising web feed means for advancing the webs along respective paths;

respective optical sensors juxtaposed each web path and arranged to output respective signals on sensing predetermined marks on their corresponding webs, non-simultaneous occurence of the sensor output signals corresponding to the advance of a said mark on one said web relative to corresponding mark or marks on the, or the other, webs;

web feed rate control means operative upon non-simultaneous occurence of the sensor output signals to vary the relative feed rates of the webs with respect to each other until the said signals occur together indicating that said advance has been annulled; and said web feed means including respective pairs of drive rollers for each web and said feed rate control means includes epicyclic gearing coupling said drive roller pairs, said epicyclic gearing providing a speed differential between said drive roller pairs upon non-simultaneous occurance of said sensor output signals and no speed differential when said signals are simultaneous.

2. Apparatus according to claim 1, wherein the optical sensors are photoelectric cells.

3. Apparatus according to claim 1, wherein said epicyclic gearing includes an input shaft driven by a first one of said web drive rollers, an output shaft driving a second of said web drive rollers and a control shaft for providing a speed differential between said input and said output shaft.

4. Apparatus according to claim 3 further including a drive motor for driving said control shaft, said drive motor being activated by said non-simultaneous occurance of said sensor output signal.

5. Apparatus according to claim 3, wherein said epicyclic gearing includes a spider box and said control shaft drives said spider box.

6. Apparatus according to claim 3 wherein said control shaft is rotatable in first and second directions, upon rotation in said first direction said output shaft being rotated faster than said input shaft, upon rotation in said second direction said output shaft rotating slower than said input shaft, and means responsive to said sensor output signal for driving said control shaft in said first and said second directions.

7. Apparatus according to claim 6 in which said responsive means comprise an electric motor.

* * * * *